US007017775B2

(12) United States Patent
Zettle et al.

(10) Patent No.: US 7,017,775 B2
(45) **Date of Patent: *Mar. 28, 2006**

(54) CONTAINER LID INCLUDING VENTING AND DENESTING FEATURES, AND CONTAINER HAVING SUCH A LID

(75) Inventors: Jeffrey J. Zettle, Bay County, MI (US); David A. Smith, Waukesha County, WI (US); Donald E. Hodge, Isabella County, MI (US); Eric Schaper, Midland County, MI (US); Peter T. Evers, Midland County, MI (US)

(73) Assignee: S.C. Johnson & Son, Inc., Racine, WI (US)

( * ) Notice: Subject to any disclaimer, the term of this patent is extended or adjusted under 35 U.S.C. 154(b) by 678 days.

This patent is subject to a terminal disclaimer.

(21) Appl. No.: 09/370,913

(22) Filed: Aug. 10, 1999

(65) Prior Publication Data

US 2002/0148845 A1 Oct. 17, 2002

(51) Int. Cl.
*B65D 43/03* (2006.01)

(52) U.S. Cl. ..... 220/781; 206/508; 220/366.1; 220/380; 220/801; 220/802; 220/805

(58) Field of Classification Search ..... 220/380, 220/367.1, 366.1, 801, 802, 796, 781, 805, 220/782, 784, 785, 787, 789, 790, 791, 793; 206/515, 508

See application file for complete search history.

(56) References Cited

U.S. PATENT DOCUMENTS 1,109,649 A 9/1914 Lang, Jr.
1,786,733 A 12/1930 Benoit
1,800,846 A 4/1931 Slagel
1,843,918 A 2/1932 Cornell
2,109,484 A 3/1938 Hothersall
2,752,970 A 7/1956 Tupper
2,765,831 A 10/1956 Tupper
2,767,711 A 10/1956 Ernst
3,044,610 A 7/1962 Tupper
3,061,139 A * 10/1962 Edwards ..... 220/781 X
3,112,841 A 12/1963 Martinelli
D198,057 S 4/1964 Swett
3,179,283 A 4/1965 Amberg
3,204,813 A 9/1965 McCuskey et al.
3,206,059 A * 9/1965 Fead et al. ..... 220/792
3,262,602 A 7/1966 McConnell et al.
3,339,786 A 9/1967 Biglin
3,362,565 A 1/1968 McCormick
3,384,263 A 5/1968 Bernstein
3,401,825 A 9/1968 Weiss
3,424,342 A 1/1969 Scopp et al.
3,448,888 A 6/1969 Smith et al.
3,516,572 A 6/1970 Davis
3,526,334 A 9/1970 Ashton et al.
3,550,808 A 12/1970 Mounts et al.
3,589,552 A 6/1971 Fitzgerald et al.

(Continued)

FOREIGN PATENT DOCUMENTS

JP 09002539 7/1997

*Primary Examiner*—Robin A. Hylton

(57) ABSTRACT

A selectively detachable container lid includes a center panel and a peripheral sealing lip surrounding the panel. The peripheral sealing lip has a generally inverted U-shaped cross section so as to define a channel into which a bowl rim fits. The lid also includes at least one ridge formed between the panel and the peripheral sealing lip. The ridge is interrupted by at least one gap. The ridge and the peripheral sealing lip partially overlap when viewed in a direction substantially normal to the panel. The ridge also abuts the bowl when the lid is placed loosely on the bowl. Also disclosed is a container that includes such a lid.

20 Claims, 5 Drawing Sheets

U.S. PATENT DOCUMENTS 3,612,342 A 10/1971 Rathbun
3,613,938 A 10/1971 Westcott
3,632,016 A 1/1972 Bozek
3,722,731 A 3/1973 McCormick et al.
3,743,133 A 7/1973 Rathbun
D228,542 S 10/1973 Swett
3,773,207 A * 11/1973 Dokoupil et al. .... 220/367.1 X
3,794,090 A 2/1974 Commisso
3,797,694 A 3/1974 See et al.
3,931,890 A 1/1976 Davis
3,967,731 A * 7/1976 Boduch ..... 206/508
4,051,951 A 10/1977 Smith
4,076,123 A 2/1978 Davis
4,201,311 A * 5/1980 Underwood ..... 220/789 X
4,215,797 A 8/1980 Chen
4,256,240 A * 3/1981 Woinarski ..... 206/508 X
4,275,815 A 6/1981 Davis
4,286,713 A 9/1981 Marchais
4,311,238 A * 1/1982 Smith ..... 206/508
D263,685 S 4/1982 Smith
4,412,630 A 11/1983 Daenen
4,471,880 A 9/1984 Taylor et al.
4,538,741 A * 9/1985 Jacobs ..... 220/782 X
4,562,937 A 1/1986 Iyengar
4,620,642 A 11/1986 Wertz et al.
4,621,670 A 11/1986 Yuen
4,705,172 A 11/1987 Gage
4,753,365 A 6/1988 Seppala
4,760,936 A 8/1988 Mueller
4,809,868 A 3/1989 Pomroy
4,847,459 A 7/1989 Desai
5,012,061 A 4/1991 Lesser
5,065,889 A 11/1991 Conti
5,147,059 A 9/1992 Olsen et al.
D339,958 S 10/1993 Olsen et al.
D344,209 S 2/1994 Cousins et al.
D344,210 S 2/1994 Cousins et al.
5,356,026 A 10/1994 Andress et al.
5,377,860 A 1/1995 Littlejohn et al.
5,377,861 A 1/1995 Landis
5,388,714 A 2/1995 Zutler
5,395,005 A 3/1995 Yoshida
5,425,467 A 6/1995 Feer et al.
5,427,266 A 6/1995 Yun
D362,389 S 9/1995 Frye
D378,563 S 3/1997 Ferris
5,624,051 A 4/1997 Ahern, Jr. et al.
D379,133 S 5/1997 Ahern, Jr. et al.
5,657,895 A 8/1997 Rogge
5,692,616 A 12/1997 Baker
5,695,086 A 12/1997 Viola
D390,109 S 2/1998 Tucker et al.
5,791,509 A 8/1998 Rush et al.
5,810,197 A 9/1998 Mazzarolo
5,894,953 A 4/1999 Ramirez
D411,714 S * 6/1999 Wilson et al. ..... D7/602
D411,741 S * 6/1999 Wilson et al. ..... D9/425
5,992,679 A * 11/1999 Porchia et al. ..... 220/805 X
6,032,827 A * 3/2000 Zettle et al. ..... 220/805 X
6,105,810 A 8/2000 Daenen et al.
6,164,484 A 12/2000 Fiore et al.
6,168,044 B1 * 1/2001 Zettle et al. ..... 220/790 X
6,170,696 B1 * 1/2001 Tucker et al. ..... 206/508 X
D440,830 S 4/2001 Tucker et al.
D443,184 S 6/2001 Maxwell et al.
6,257,401 B1 7/2001 Mangla et al.
6,305,546 B1 10/2001 Saunders et al.
6,349,847 B1 2/2002 Mangla et al.
6,367,651 B1 4/2002 Laib et al.

* cited by examiner

CONTAINER LID INCLUDING VENTING AND DENESTING FEATURES, AND CONTAINER HAVING SUCH A LID

BACKGROUND OF THE INVENTION

1. Field of Invention

The present invention generally relates to a lid for a container that is useful in storing or transporting items such as food, and more particularly, to a selectively detachable container lid having unique venting and denesting features, and a container employing the same.

2. Description of the Related Art

Containers generally have a lid selectively detachable from a bowl and are commonly designed to provide a variety of features, including being reusable, disposable, microwavable, and the like. Generally, these types of containers should be relatively low in cost and easy to use. Depending on their intended use, the containers should be capable of withstanding such varied conditions as those presented by a freezer, microwave, dishwasher and the like.

One problem associated with a conventional, microwavable container stems from the rapid temperature changes that it must endure. The container must be permitted to vent during microwaving due to the high pressures that arise as moisture in the container contents vaporizes and gas temperatures increase. Thus, the container must be left open to some degree during microwaving. However, it is also desirable to keep the bowl covered as much as possible to prevent the contents from splattering the inside of the microwave. One common practice is to remove the lid and place it loosely over the container bowl so that air and steam can escape during microwaving. Another common practice is to only partially remove the lid (i.e., "crack open" the lid) by disengaging only part of the lid from the bowl. This creates an air passage only where the lid has been disengaged from the bowl. Both of these practices generally permit sufficient air and steam to vent during microwaving because the increased pressure within the container will tend to force the container open, increasing any space between the lid and the bowl. However, once microwaving is complete, the steam will cool and the pressure in the container will drop significantly. Because the pressure differential no longer tends to open the container, the above-noted venting practices often do not permit sufficient air to vent back into the container to compensate for the pressure drop. This problem can be aggravated by the accumulation of steam or vapor, which can form a vapor seal between the lid and bowl. A vacuum can result, and the container can be damaged and could ultimately implode.

Another problem results from the fact that when such container lids are thermo-formed, they typically have complementary top and bottom surfaces. When multiple lids are stacked for shipment or storage, adjacent lids often become jammed or interlocked when they nest. This can make the lids very difficult to manipulate, especially by automated handlers in a production line.

There have been many attempts in the art to provide containers that address venting and/or stacking concerns. For example, U.S. Pat. No. 3,091,360 (the "'360 patent") to Edwards, entitled "Nestable Cup", provides a reversely-tapered ring adjacent to the bottom of a cup. To prevent stacked cups from nesting too tightly, a shelf is provided at the top of the ring to accommodate the bottom of the ring of an adjacent cup. The ring includes a plurality of wedge-shaped protuberances separated by spaces that act as air vents between adjacent cups to prevent the cups from suctioning to one another. While addressing concerns regarding stacked cups, the design of the '360 patent is not suitable for stacking lids, and it does not address the venting concerns discussed above.

U.S. Pat. No. 3,362,565 (the "'565 patent") to McCormick entitled "Container Lid", provides a lid with a sidewall, which has a sealing bead near its base and a shoulder near its top. The sealing bead seals against an internal shoulder provided in a container. When the lids are stacked, the sealing bead rests on the shoulder of the lid below. Notches are intermittently disposed about an outer periphery of the sealing bead. These notches provide a venting passageway through which gases generated in a sealed container can escape when the gas or vapor pressure is sufficient to flex the lid upward at its center, causing a fulcruming action. These notches allow venting when the lid has been fully seated on the container, but do not address the above-noted venting concerns when the lid is loosely seated on or only partially removed from a container.

U.S. Pat. No. 3,589,552 (the "'552 patent") to Fitzgerald, entitled "Container", includes a stacking ring on top of a container lid to facilitate separation of stacked lids by a mechanical capping device. A series of interruptions are disposed throughout the stacking ring to prevent the lid from suctioning to an adjacently stacked lid or the mechanical capping device. However, the '552 patent likewise does not address the venting problems that arise when the lid is loosely seated on or only partially removed from the container.

Another approach was taken in U.S. Pat. No. 3,339,786 (the "'786 patent") to Biglin, entitled "Container and Venting Closure Cap for Same". A tapered wall with a shelf at its top provides for stacking plural caps. Small ribs or beads across the interior surface of a container sealing channel permit the venting of gases from a capped container. If sufficient internal pressure develops, the gases can freely escape. The '786 patent also does not address venting of a loosely-seated or partially-removed lid.

U.S. Pat. No. 5,147,059 (the "'059 patent") to Olsen et al., entitled "Seal With Automatic Release", provides a series of vent-defining protuberances on the inner surface of a vertical, outer sealing portion of a lid. The protuberances engage a container rim to permit venting when the lid is loosely placed on the container. The venting prevents internal/external pressure differentials that might resist the proper seating and removal of the lid. The '059 patent, however, does not address stacking or denesting lids.

U.S. Pat. No. 5,791,509 (the "'509 patent") to Rush et al., entitled "Uniform Stacking Cup Lid", provides a lid having an annular trough with an outer wall. The upper portion of the outer wall has a shelf, and the lower portion of the outer wall is negatively sloped and serves as a stacking ring. Positive-draft flutes are spaced periodically around the circumference of the stacking ring to stabilize the stacking ring during thermo-form mold release. The stacking ring of one lid and the shelf of an adjacently stacked lid cooperate to prevent nesting. The '509 patent, however, does not provide a mechanism for preventing a vapor seal between a corresponding lid and bowl.

U.S. Pat. No. 4,753,365 (the "'365 patent") to Seppala, entitled "Lid With Removable Tab", provides a lid with a spacer having an outer sidewall, at an upper end of which is an annular seat. The annular seat receives a lower end of the spacer of an above-stacked lid. The '365 patent does not attempt to remedy the vapor seal problem discussed above.

What is needed in the art is a container lid that remains properly oriented and allows venting into and out of the container while being loosely positioned on or partially removed from a bowl, and includes structure that facilitates denesting when stacked with other lids.

In order to simplify design and production, it is desirable to provide a lid in which the structure that facilitates venting of a loosely-placed or partially-removed lid also facilitates denesting of stacked lids.

There is an additional need in the art to provide an inexpensive lid and bowl design that incorporates the above-mentioned objectives.

SUMMARY OF THE INVENTION

The present invention has been made in consideration of the above-described problems in the art.

An object of the invention is to provide a container and lid having both the venting capabilities and denesting features discussed above.

According to one aspect, the present invention relates to a lid for use with a bowl having a sidewall terminating in a rim. The lid includes a center panel and a peripheral sealing lip surrounding the panel. The peripheral sealing lip has a generally inverted U-shaped cross section so as to define a channel into which the bowl rim fits. The lid also includes at least one ridge formed between the panel and the peripheral sealing lip, the ridge being interrupted by at least one gap. The ridge and the peripheral sealing lip also at least partially overlap when viewed in a direction substantially normal to the panel. The ridge abuts the bowl rim when the lid is placed loosely on the bowl.

According to another aspect, the present invention relates to a lid for use with a bowl, having a sidewall terminating in a rim. The lid has a center panel and a peripheral sealing lip surrounding the panel. The peripheral sealing lip has a generally U-shaped cross section defined by an inner wall, an outer wall, and an annular web disposed between the inner wall and the outer wall. The lid also features venting and denesting means disposed between the panel and the inner wall for venting the bowl when the lid is loosely positioned on the container, and for abutting a corresponding lid to impede nesting when the lid is stacked upon the corresponding lid.

According to still another aspect, the present invention relates to a container including a bowl, having a sidewall terminating in a rim, and a selectively detachable lid. The lid includes a center panel and a peripheral sealing lip surrounding the panel. The peripheral sealing lip has a generally inverted U-shaped cross section so as to define a channel into which the bowl rim fits. The lid also includes at least one ridge formed between the panel and the peripheral sealing lip. The ridge is interrupted by at least one vent opening, and the ridge and the peripheral sealing lip at least partially overlap when viewed in a direction substantially normal to the panel. The ridge also abuts the bowl rim when the lid is placed loosely on the bowl, and the vent opening defines an air passageway between the bowl and ambient air when the lid rests loosely on the bowl.

The brief summary has been provided so that the nature of the invention may be generally understood. However, this summary should not be construed to limit the invention. The foregoing and other objects, aspects, features and advantages of the present invention will become more apparent from the following detailed description of the preferred embodiments taken in conjunction with the accompanying drawings, in which like reference numbers have been used for like or similar elements throughout the views.

DETAILED DESCRIPTION OF THE PREFERRED EMBODIMENTS

Figure 1:
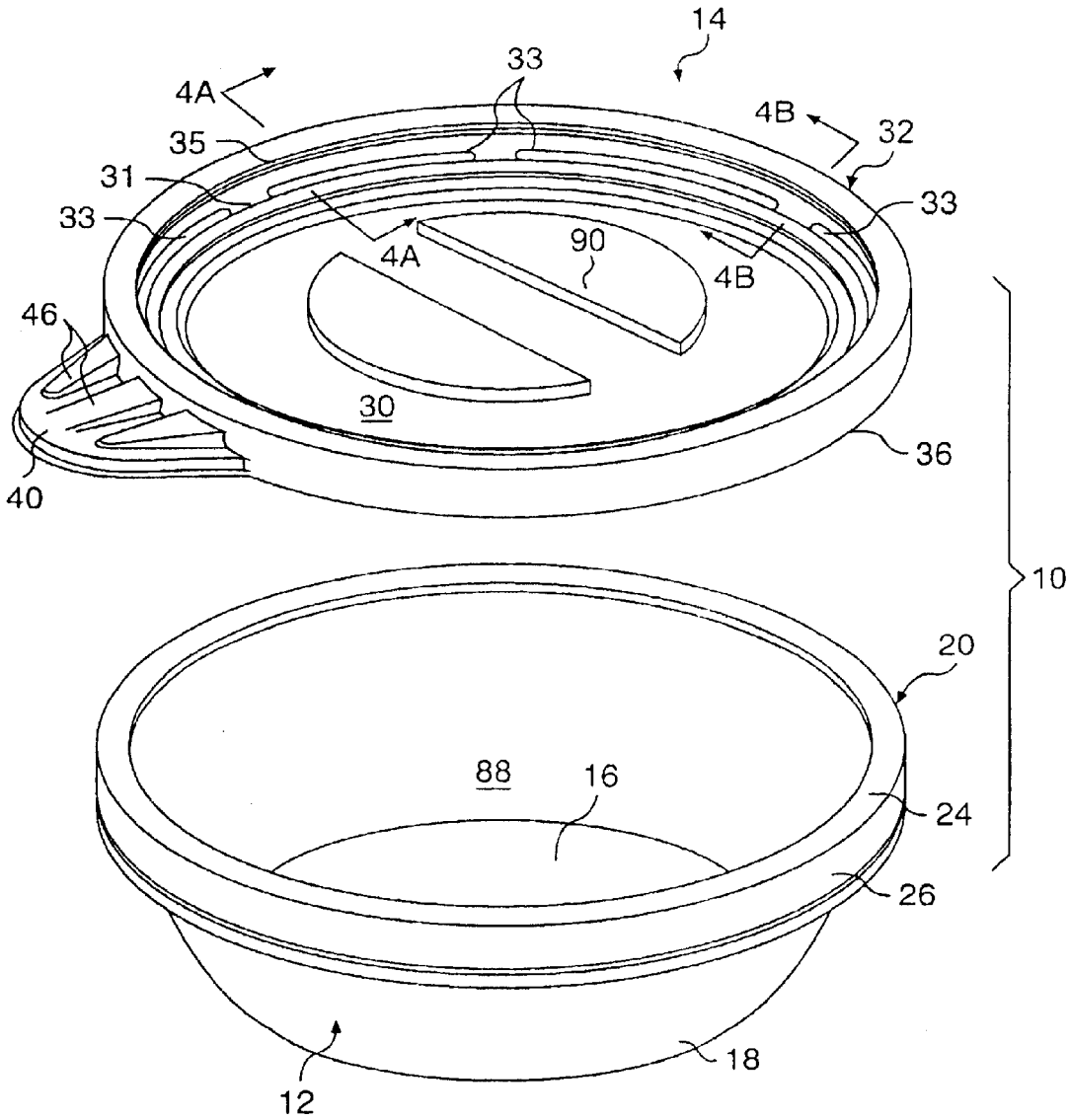
FIG. 1 is a perspective view of a disassembled container including a bowl and a selectively detachable lid in accordance with the present invention.

FIG. 1 shows a preferred embodiment of a container 10 that includes a bowl 12 and a selectively detachable lid 14 formed in accordance with the present invention. While the container 10 is illustrated generally as being round, the principles of the present invention equally apply to containers of various shapes, such as oval, rectangular, or square, for example.

Figure 2:
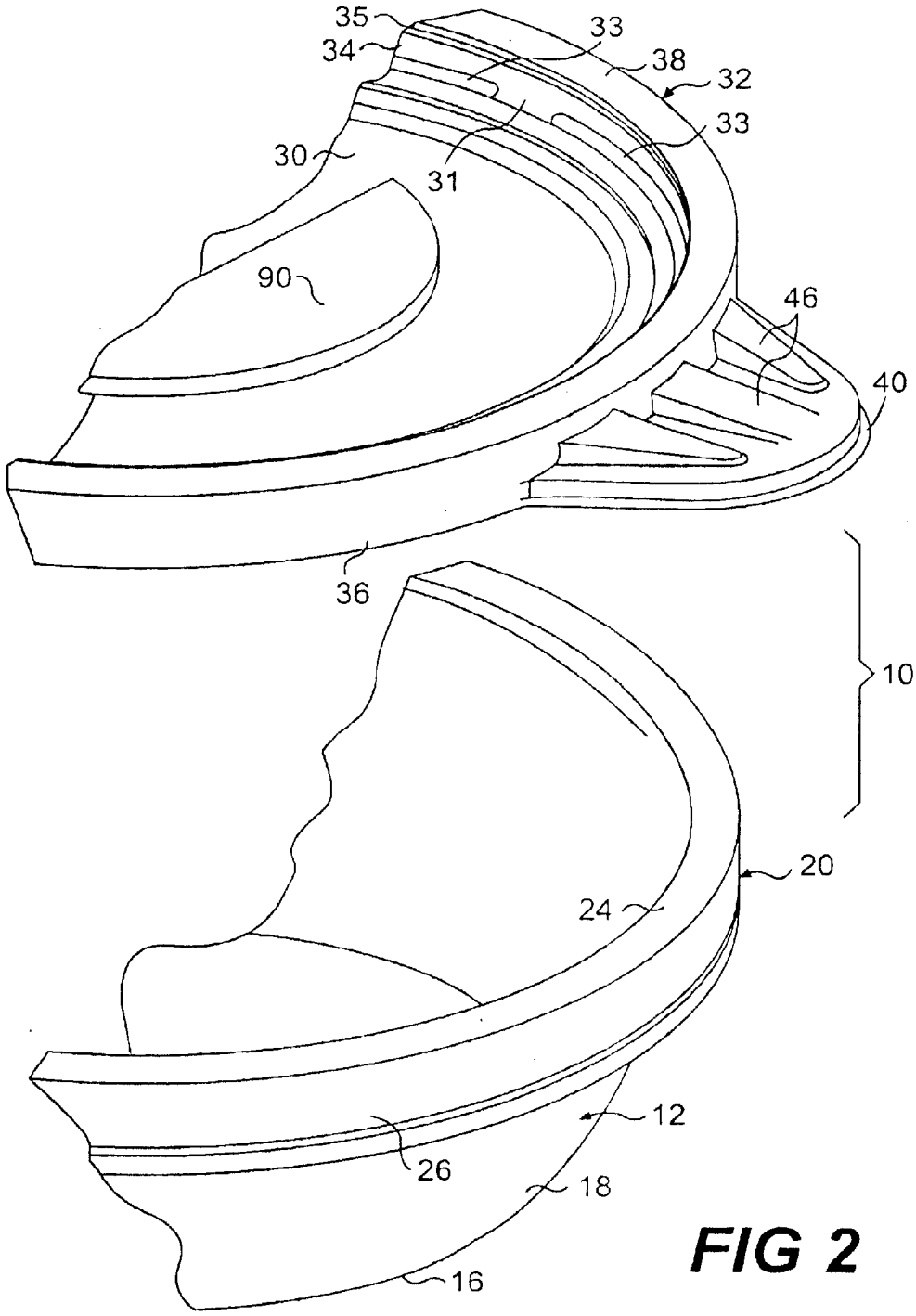
FIG. 2 is a partial perspective view of a disassembled container including a bowl and a selectively detachable lid in accordance with the present invention.
Figure 3:
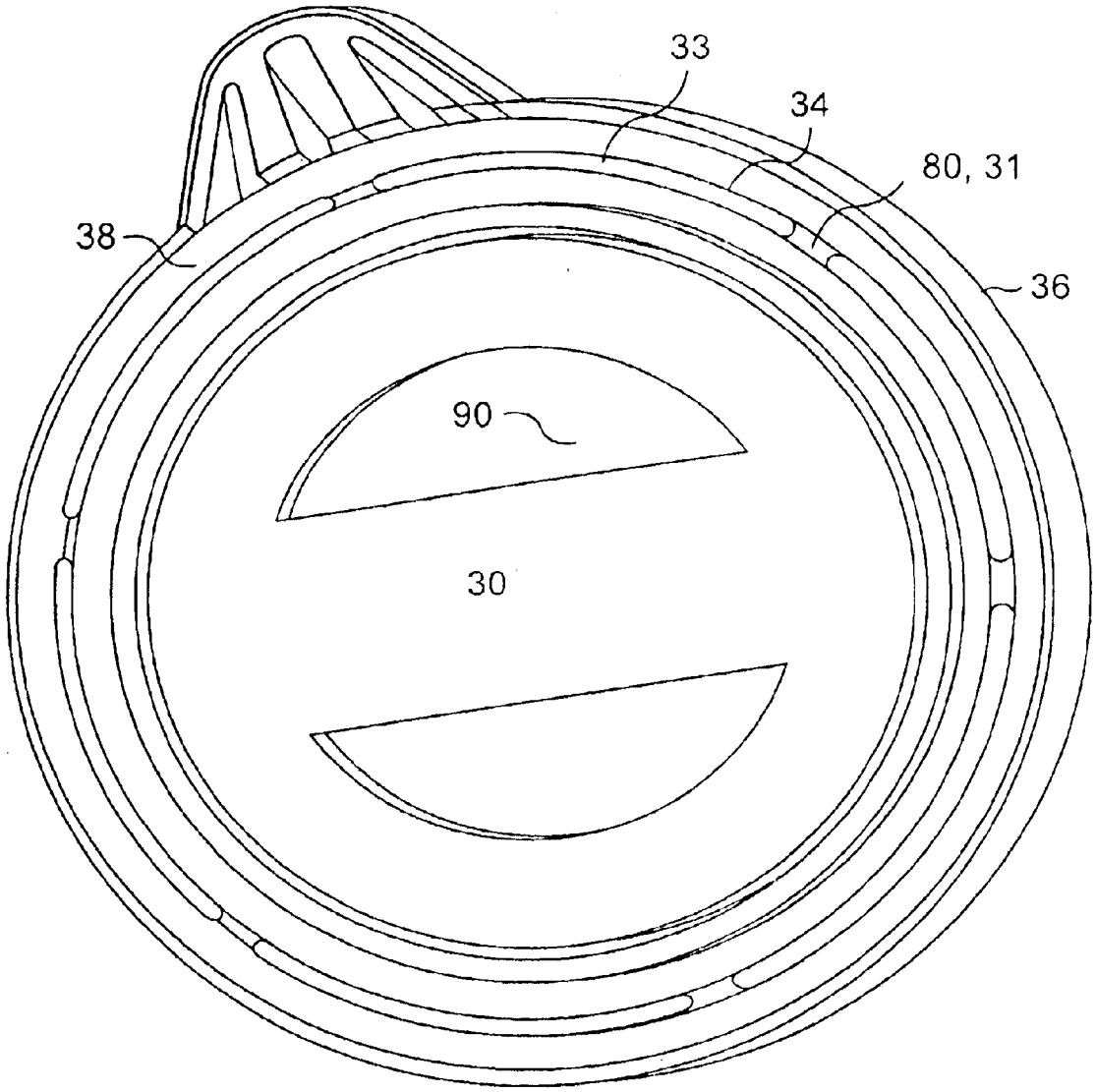
FIG. 3 is a bottom view of the container lid shown in FIG. 1.

As seen in FIGS. 1 and 2, the bowl 12 generally includes a bottom 16 and a continuous sidewall 18 extending up from the bottom 16 to define a bowl cavity 88. The top of the sidewall 18 terminates in a substantially continuous rim 20 which defines the mouth of the bowl. In the preferred embodiment, the rim 20 is substantially L-shaped in cross section and includes an annular flange 24, which extends outwardly from the sidewall 18, and a skirt 26, which extends downwardly from the annular flange 24. It should be noted that directional terms such as "down", "above" or "horizontal" are used herein to facilitate the description, generally with reference to the orientation of a container resting—lid up—on a horizontal surface, and these terms should not be construed to limit the scope of the invention.

Figure 5:
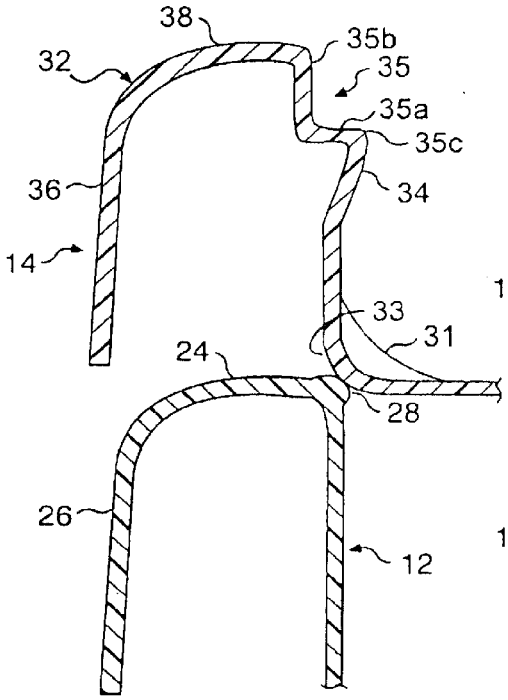
FIG. 5 is a partial sectional view of the lid and bowl shown in FIG. 1 in a loosely stacked arrangement.

As best illustrated in FIG. 5, an annular nub 28, which is relatively rigid, may extend inwardly from the upper portion of the sidewall 18. The nub 28 provides positive resistance as the lid 14 is seated and unseated from the bowl rim 20. To remove the lid 14 from the bowl 12, ridges 33 (discussed in more detail below) and a portion of an inner wall 34 must be moved past the relatively rigid nub 28. Thus, the nub 28 assists in maintaining the engagement between the lid 14 and the bowl 12.

The lid 14 generally includes a central panel 30 and a peripheral lip 32, extending from the panel 30. When the lid 14 is secured to the bowl 12, the panel 30 covers the bowl, and the lip 32 of the lid 14 interfits with the rim 20 of the bowl 12.

Figure 4A:
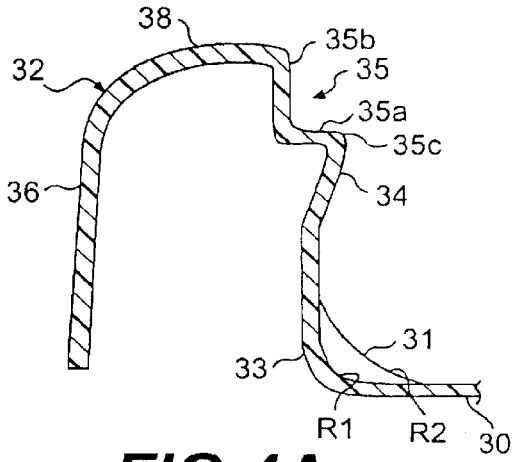
FIG. 4A is a partial sectional view taken along the line 4A—4A of FIG. 1.
Figure 4B:
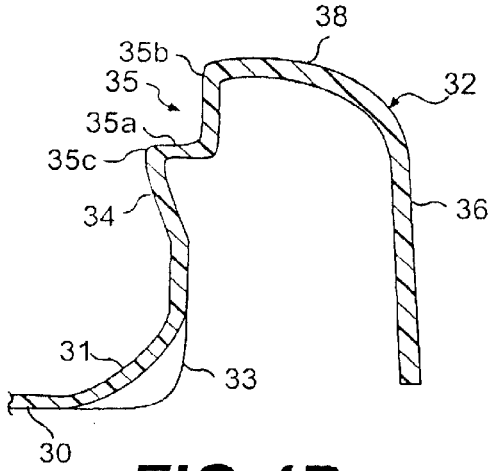
FIG. 4B is a partial sectional view taken along the line 4B—4B of FIG. 1.

As shown most clearly in FIGS. 4A and 4B, the lip 32 has a generally inverted U-shaped cross section and includes an inner wall 34 extending up from the panel 30, an annular web 38 extending out from the inner wall 34, and an outer leg 36 depending from the web 38. When the lid 14 is secured to the bowl 12, with the bowl rim 20 (including, optionally, the annular nub 28) within the lip 32 of the lid 14, the inner surface of the sidewall 18 of the bowl 12 provides an interference fit with the inner wall 34 of the lid 14. Hence, lip 32 of the lid 14 acts as a sealing channel to receive the rim 20 of bowl 12.

As shown in FIGS. 1, 3, 4A and 4B, at a transition between the panel 30 and the lip 32 of the lid 14 is a series of discrete, elongated ridges 33 separated by a plurality of gaps 31. The gaps 31 are also referred to as vent openings, and their function will be described below.

We prefer that the ridge/gap configuration depend from a bead 80 extending from the underside (or conversely, depressed into the top) of the lid 14. While not necessary to the performance of the ridge/gap configuration, the bead 80 provides strength and rigidity to the lid 14, particularly as the lid 14 is flexed during seating on or unseating from the bowl 12. Whether the gaps 31 are viewed as depressions into the bead 80 or the ridges 33 are viewed as protuberances from the bead 80 is not crucial, as long as the ridges 33 are raised relative to the gaps 31.

The ridges 33 are configured to abut the rim 20 of the bowl 12 when the lid 14 rests loosely on the bowl 12. The combination of the ridges 33 and vent openings 31 provides a unique venting feature of our invention. When the lid 14 is placed loosely on or partially removed from (e.g., not sealing closed, but still covering) the bowl 12, as shown in FIG. 5, the ridges 33 abut the rim 20 of the bowl 12. In the preferred embodiment, the ridges 33 abut an inner portion of the annular flange 24 and/or the nub 28. The ridges 33 support the lid 14 on the bowl 12, and the vent openings 31 create an air passageway between the lid 14 and the rim 20 (e.g., the annular flange 24 and, where applicable, the nub 28). Accordingly, air can be vented into and out from the container, avoiding the venting problems discussed above.

Figure 7:
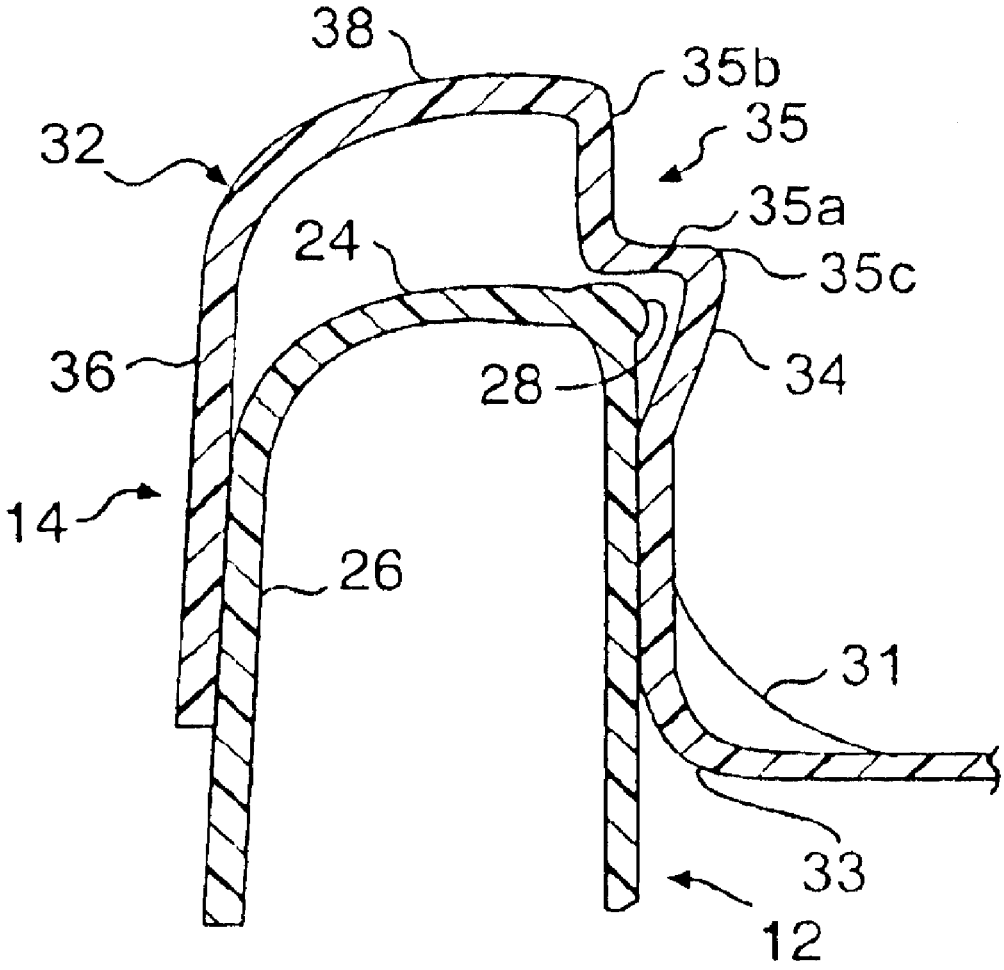
FIG. 7 is a partial section view of the lid seated on the bowl.

When the container is closed, as shown in FIG. 7, an interference fit with the sidewall 18 of the bowl 12 occurs on the inner wall 34 above the ridges 33. Thus, once the lid 14 is fully seated on the bowl 12, the ridges 33 and vent openings 31 do not provide any venting since they are disposed within the bowl cavity 88. Hence, a container constructed according to the present invention can provide venting when lid 14 rests loosely on the bowl 12, and can provide an airtight seal when the lid 14 is fully seated on the bowl 12.

Figure 6:
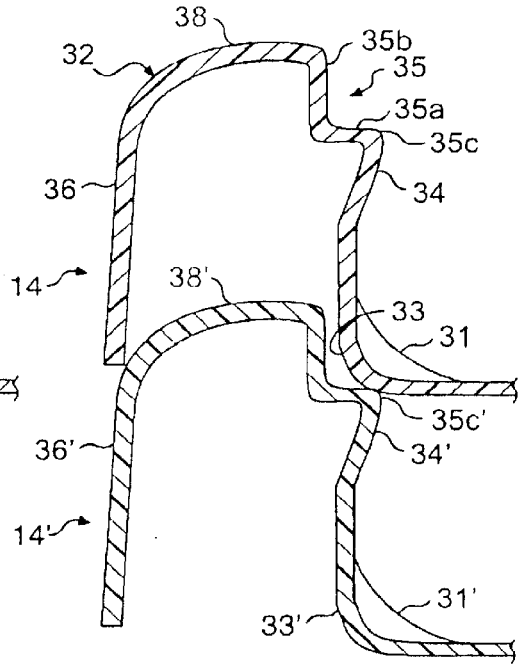
FIG. 6 is a partial sectional view of two stacked lids.

Another advantage of the present invention is a denesting and stacking feature. When viewed in a direction substantially normal to the panel 30, the ridges 33 and the lip 32 of the lid 14 at least partially overlap. This can be accomplished by tapering inner wall 34 of the lip 32 (as in the illustrated embodiment) and/or by projecting the ridges 33. Thus, as shown in FIG. 6, when two lids are stacked, the ridges 33 of one lid rest on the lip 32 of the lid below. The ridges 33 provide a contact surface that helps prevent adjacently stacked lids from interfitting too closely and becoming jammed.

To further enhance the stacking and denesting features of the present invention, the lip 32 may include an annular shelf 35 disposed at or near the junction of the inner wall 34 and the web 38, preferably at a top section of the inner wall 34, as best seen in FIG. 6. In the illustrated embodiment, the shelf 35 includes a generally horizontal seat 35*a* and an upstanding wall 35*b*. Alternatively, by way of example, the shelf 35 could be a gradually sloping groove, a partial-cylindrically shaped channel, or the like.

As shown in FIG. 6, which is a partial sectional view of the stacked lids 14 and 14', the shelf 35' of one lid 14' is designed to receive the ridges 33 of the other lid 14. Conversely, the ridges 33 are sized so as to rest on the shelf 35' of the adjacent lid. Thus, the ridges 33 ride on the shelf 35' of the adjacent lid 14', which helps to maintain the alignment of adjacent lids 14, 14' while preventing the lids from completely nesting.

When viewed from above or below, the shelf 35 can be formed so that an innermost edge 35*c* of the seat 35*a* defines a smaller diameter (in the case of a circular lid; is closer to the center if the lid is non-circular) than does the widest portion of ridges 33. In the illustrated embodiment, the inner wall 34 just below the shelf 35 slants away from center towards its outermost portion, which is where the lid 14 forms an interference fit with the bowl 12 when the container is closed. The ridges 33 are preferably approximately flush with or slightly recessed from the outermost portion of the inner wall 34 so as not to interfere with the above-noted interference fit. The innermost edge 35*c* of the shelf 35 is radially inside the ridges 33. As an alternative arrangement, the inner wall 34 may be substantially entirely vertical. In such an arrangement, the ridges 33 can extend radially beyond the inner wall 34 into the sealing channel formed by sealing lip 32. In either case, the ridges 33 can ride on the shelf 35 of a lid stacked below, achieving a denesting feature.

The interaction of the ridges 33 and the lip 32 allows lids to be stacked adjacently without sufficiently nesting to jam together. The resulting stack of lids can be separated without undue effort.

In the illustrated embodiment, there are six ridges 33 and six substantially equally spaced vent openings 31. The number and size of the ridges and vent openings, and the spacing between them is not critical, and can be varied as long as there is sufficient venting and stacking provided. For example, the lid could include a single ridge 33 interrupted by as few as one vent opening 31. As will be appreciated, the lid 14 could also contain many more than six smaller ridges 33, separated by a plurality of vent openings 31.

Similarly, specific dimensions of the illustrated container lid are not critical as long as the above-discussed principles are applied. By way of example, the illustrated shelf 35 includes a seat 35*a* having a depth of approximately 0.040 inches (1.016 mm), and a wall 35*b* having a height of about 0.066 inches (1.676 mm). The edge 35*c* of the seat 35*a* defines a circle having a diameter of about 5.083 inches (12.91 cm). The outermost portion of the inner wall 34 defines a circle having a diameter of approximately 5.123 inches (13.012 cm). The ridges 33 are recessed by about 0.005 inches (0.127 mm) from the outermost portion of the inner wall 34. Therefore, when properly stacked and aligned, the ridges 33 of one lid will overlap the seat 35*a* of an adjacent lid by approximately 0.015 inches (0.381 mm). The ridges 33 also project about 0.025 inches (0.635 mm) above the gaps 31. One way to achieve this effect is to provide the ridges and gaps with different radii of curvature. For example, the radii R1 and R2 of the ridge 33 and gap 31, respectively, (see FIG. 4A) can be about 0.048 (1.219 mm) and 0.117 inches (2.972 mm), respectively. Finally, it is noted that the circumferential length of each ridge 33 is about 2.37 inches (6.02 cm), with each gap 31 having a circumferential length of about 0.25 inches (0.635 cm).

The lid of the present invention provides significant advantages over conventional lids, both in venting and denesting. For example, a 14 oz. container employing a lid according to the above-described embodiment of the present invention was subjected to a venting test, in which a small amount of water (enough to cover the bottom of the container) was placed in the container with the lid partially opened (i.e., cracked open). The container was microwaved on high for two minutes and then permitted to cool for one minute in the microwave. The test was severe, causing containers employing comparative sample lids (without ridges/gaps) to reseal and implode in each of 20 test runs. However, the containers employing the inventive lid did not reseal or sustain any damage in any of 33 test runs.

Accordingly, the present invention utilizes a single structure (e.g., the ridges 33 separated by the vent openings 31) to facilitate both venting a container having a loosely seated lid and aligning and denesting a plurality of stacked lids. Hence, significant cost savings and an efficient container design can be achieved using the principles of the present invention.

As an optional feature, the underside of bottom 16 may include an annular projection, or alternatively, a circular indentation. The panel 30 could include a complementary circular (or part-circular) raised area 90, as shown in FIG. 1. The raised area 90 nests within the circular indentation or the annular projection of the bottom 16 of a bowl stacked above. In this manner, sealed containers can be stacked one on top of another. Of course, the raised area 90 and indentation or projection can be shaped differently, but it is preferred that at least the indentation or projection be generally circular to permit stacking regardless of orientation. These nesting features can also be reversed, with the raised area being on the bottom of the bowl 12 instead of on the top of the lid 14.

As another optional feature, the lid 14 may include a rigid tab member 40 extending outwardly from the outer wall 36 of lip 32. The tab member 40 can be substantially triangular and includes a plurality of upstanding ribs 46 to maximize its rigidity and thereby enhance the transfer of separation forces from the tab member 40 to the sealing region. The advantages, dimensions and features of a container having a tab member are described in U.S. patent application Ser. Nos. 09/104,739, 09/104,743 and 09/104,508, each filed on Jun. 25, 1998, and assigned to the assignee of this application, and each is hereby incorporated by reference in its entirety.

It is a common practice to vent a lid with such a tab member 40 by pulling on the tab member 40 to partially open the container (i.e., crack open the lid) at the tab member 40. Thus, because the region near the tab member 40 is a likely location for the container to be vented, it is preferred that at least one of the gaps 31 be aligned with the tab member 40.

As will be appreciated, the containers of the present invention can be economically thermo-formed or molded by any well-known technique from any one of a number of known thermoplastic resins including, but not limited to, polyamides, polyacrylics, polyarylates, polycarbonates, polyesters, polyetherimides, polyetherketones, polyolefins, polyphehylenes, polyvinylchlorides, and various styrene and liquid crystal polymers, among others.

Although specific, preferred embodiments of the present invention have been described in detail, it will be understood that this description is merely for purposes of illustration. Various modifications of and equivalent structure corresponding to the disclosed aspects of the preferred embodiments, in addition to those described above, may be made by those skilled in the art without departing from the spirit of the following claims. For example, those of ordinary skill in the art will appreciate that certain variations in the size, shape and number of the protrusions and the arrangement and material of various portions of the disclosed container lid may be made without departing from the spirit of the invention. Accordingly, the scope of the invention defined by the following claims should be accorded the broadest reasonable interpretation so as to encompass such modifications and equivalent structures.

INDUSTRIAL APPLICABILITY

The improved container of the present invention is suitable for many applications, particularly mass-produced food containers which are intended for use in microwave ovens. The lid of the container is designed to facilitate handling a plurality of such lids that are stacked for shipment or storage. The lid also provides, selectively, vented coverage or airtight sealing of the container.

We claim:

1. A container comprising:

a bowl having a sidewall terminating in a rim; and a lid, said lid including:

(i) a center panel;

(ii) a peripheral sealing lip surrounding said panel, said peripheral sealing lip having a generally U-shaped cross section defined by an inner wall, an outer wall, and an annular web disposed between said inner wall and said outer wall, the inner wall, the outer wall, and the annular web defining a channel into which the rim fits; and (iii) venting and denesting means disposed between said panel and said inner wall for venting said container when said lid is loosely positioned on the bowl such that the channel is substantially aligned with the rim of the bowl, and for abutting a corresponding lid to impede nesting when said lid is stacked upon the corresponding lid, said venting and denesting means comprising at least one ridge that is interrupted by at least one gap, said ridge having a circumferential length that is greater than the circumferential length of gap.

2. A container according to claim 1, wherein said venting and denesting means defines at least one air passageway between the bowl and lid when said lid rests loosely on the bowl.

3. A container according to claim 1, wherein a plurality of said ridges are separated by a plurality of said gaps and are distributed substantially evenly about said lid.

4. A container according to claim 3, wherein the circumferential length of each of said gaps is about 0.25 inches.

5. A container according to claim 3, wherein said ridges have a different radius of curvature than that of said gaps, with said ridges projecting above said gaps by about 0.025 inches.

6. A container according to claim 1, wherein said peripheral sealing lip further defines receiving means for receiving said venting and denesting means of an adjacently stacked lid.

7. A container according to claim 6, wherein said receiving means comprises a seat surrounded by a generally upstanding wall, wherein when said lid is stacked upon a second such lid, said venting and denesting means rests upon said seat of said second lid.

8. A container according to claim 7, wherein said receiving means further comprises an inwardly extending shelf, and said seat is disposed on said shelf.

9. A container according to claim 1, wherein said peripheral sealing lip further comprises a rigid tab member extending from said outer wall.

10. A container comprising:

a bowl, having a sidewall terminating in a rim; and a selectively detachable lid, said lid including:

(i) a center panel;

(ii) a peripheral sealing lip surrounding said panel, said peripheral sealing lip having a generally inverted U-shaped cross section so as to define a channel into which said bowl rim fits; and (iii) at least one ridge formed between said panel and said peripheral sealing lip, said ridge being interrupted by at least one vent opening, said ridge having a circumferential length that is greater than the circumferential length of said vent opening, wherein said ridge and said peripheral sealing lip at least partially overlap when viewed in a direction substantially normal to said panel, and wherein said ridge abuts the bowl rim when said lid is placed loosely on said bowl, and wherein said vent opening defines an air passageway between the bowl and ambient air when said lid rests loosely on the bowl such that the channel is substantially aligned with the bowl rim.

11. A container according to claim 10, wherein said peripheral sealing lip further comprises a seat surrounded by a generally upstanding wall, wherein when said lid is stacked upon a second such lid, said at least one ridge rests upon said seat of said second lid.

12. A container according to claim 11, wherein said peripheral sealing lip further comprises an inwardly extending shelf, and said seat is disposed on said shelf.

13. A container according to claim 10, wherein a plurality of said ridges are separated by a plurality of said vent openings and are distributed substantially evenly about said lid.

14. A container according to claim 13, wherein the circumferential length of each of said vent openings is about 0.25 inches.

15. A container according to claim 13, wherein said ridges have a different radius curvature than that of said vent openings, with said ridges projecting above said vent openings by about 0.025 inches.

16. A container according to claim 10, wherein the generally inverted U-shaped cross section of said peripheral sealing lip includes an outer wall from which a rigid tab member extends.

17. A container according to claim 3, wherein the total circumferentail length of said ridges is greater than the total circumferential length of said gaps.

18. A container according to claim 1, wherein the container is round.

19. A container according to claim 13, wherein the total circumferential length of said ridges is greater than the total circumferential length of said vent openings.

20. A container according to claim 10, wherein the container is round.

* * * * *